US007472519B2

(12) United States Patent
Careri

(10) Patent No.: US 7,472,519 B2
(45) Date of Patent: Jan. 6, 2009

(54) DOOR JAMB

(76) Inventor: Giovanni Careri, 470 Norfinch Drive, Toront, Ontario (CA) M3N 1Y4

( * ) Notice: Subject to any disclaimer, the term of this patent is extended or adjusted under 35 U.S.C. 154(b) by 386 days.

(21) Appl. No.: 10/997,859

(22) Filed: Nov. 29, 2004

(65) Prior Publication Data

US 2006/0123719 A1 Jun. 15, 2006

(51) Int. Cl.

| | |
|---|---|
| ***E06B 1/04*** | (2006.01) |
| ***E04C 3/16*** | (2006.01) |
| ***E04C 2/38*** | (2006.01) |
| ***A47H 1/00*** | (2006.01) |

(52) U.S. Cl. ..... 52/210; 52/204.1; 52/656.4; 52/364; 160/98

(58) Field of Classification Search ..... 52/653.1, 52/656.4, 211, 210, 734.1, 215, 204.1, 204.5, 52/212, 213, 717.01; 49/504, 467, 468; 160/26, 160/98

See application file for complete search history.

(56) References Cited

U.S. PATENT DOCUMENTS

| | | | | | |
|---|---|---|---|---|---|
| 1,180,726 | A | * | 4/1916 | Keil | 52/212 |
| 1,838,129 | A | * | 12/1931 | Baum | 52/215 |
| 4,281,480 | A | * | 8/1981 | Wendt | 49/504 |
| 4,578,905 | A | * | 4/1986 | Hout | 49/504 |
| 4,674,248 | A | * | 6/1987 | Hall | 52/212 |
| 5,058,323 | A | * | 10/1991 | Gerritsen | 49/504 |
| 5,182,880 | A | * | 2/1993 | Berge et al. | 49/504 |
| 5,210,986 | A | * | 5/1993 | Hagemeyer et al. | 52/211 |
| 5,619,828 | A | * | 4/1997 | Ver Meer | 52/213 |
| 5,722,207 | A | * | 3/1998 | Anderson et al. | 52/204.55 |
| 5,758,458 | A | * | 6/1998 | Ridge | 52/204.1 |
| 5,787,660 | A | | 8/1998 | Adams | |
| 5,836,118 | A | * | 11/1998 | Thornton et al. | 52/204.1 |
| 6,125,605 | A | * | 10/2000 | Young | 52/717.01 |
| 6,223,484 | B1 | * | 5/2001 | Minter | 52/213 |
| 6,293,060 | B1 | * | 9/2001 | McKann et al. | 52/211 |
| 6,295,779 | B1 | * | 10/2001 | Canfield | 52/656.4 |
| 6,345,413 | B1 | | 2/2002 | Fletcher et al. | |
| 6,557,309 | B1 | | 5/2003 | Johnson | |
| 6,568,137 | B2 | * | 5/2003 | Ballantyne | 52/211 |
| 6,604,334 | B2 | * | 8/2003 | Rochman | 52/717.01 |
| 6,631,595 | B1 | * | 10/2003 | Minter | 52/212 |
| 2002/0069604 | A1 | * | 6/2002 | Canfield | 52/656.4 |
| 2004/0006938 | A1 | * | 1/2004 | Schiffmann et al. | 52/211 |
| 2005/0257899 | A1 | * | 11/2005 | Lee et al. | 160/98 |

FOREIGN PATENT DOCUMENTS

| | | | |
|---|---|---|---|
| GB | 2197015 | A * | 5/1988 |
| WO | WO 9505519 | A1 * | 2/1995 |

* cited by examiner

*Primary Examiner*—Robert J Canfield
*Assistant Examiner*—Ryan D Kwiecinski

(57) ABSTRACT

A plastic door jamb member, for forming a portion of a door jamb, the plastic member having a recess for receiving a wooden doorjamb portion and;

an interlocking attachment recess for interconnection with a metal reinforcement plate, so that the plastic door jamb member may be interengaged with a wooden door jamb portion, and further interengaged with a metal reinforcement plate, and installed in position as a combination door jamb assembly.

8 Claims, 5 Drawing Sheets

DOOR JAMB

FIELD OF THE INVENTION

The invention relates to a door structure for a dwelling or the like in particular to a door jamb for the prefabrication of the a door frame around a doorway.

BACKGROUND OF THE INVENTION

The construction of doorways and doors particularly in dwellings is often carried out simply by installing wooden side plates and a top plate around the door way. Wooden casings are frequently attached to the two edges of the side and top plates. The lock set recesses and hinges are then attached to the plates on opposite sides.

This system does not provide for weather proofing. Weather proofing is usually carried out by attaching some form of weather stripping around the edges of the doorway. All of this requires considerable hand work and the exercise of some degree of skill. It is also time consuming and requires on site labour. An added disadvantage however is that by simply installing the lock and hinge hardware in the wooden plates on opposite sides of the doorway, it is relatively easy for intruders to break in. The wood supporting the lock hardware installed in a typical doorway is relatively easily destroyed by a determined intruder, and the door can then simply be swung open.

For these reasons it is desirable that the doorway sideplates shall be reinforced by metal. In this way when the door lock hardware is installed, it will be much more resistant to destruction by an intruder.

Preferably weatherstripping would also be prefabricated for installation at the same time.

In the past there have been some proposals for the use of extruded plastic in the construction of a door jamb. One such example is shown in U.S. Pat. No. 5,787,660. Another example is shown in U.S. Pat. No. 6,557,309. Plastic extruded material has also been used in framing the door itself so as to provide a door sweep, as shown in U.S. Pat. No. 6,345,431. However, none of these systems have provided a door jamb system in which a combination of wooden door jamb plate and a vinyl extrusion for securing weatherproof trim.

BRIEF SUMMARY OF THE INVENTION

With a view to simplifying the foregoing structures and providing an improved combination doorjamb assembly, the invention comprises a plastic extrusion member, for forming a first portion of a door jamb, the extrusion member defining a generally 10 channel shaped recess for receiving a wooden doorjamb portion in interengagement, and the extrusion member further defining an interlocking attachment recess for interconnection with a metal reinforcement plate, whereby the plastic extrusion member may be interengaged with a wooden doorjamb plate, and further interengaged with a metal reinforcement plate, and installed in position as a combination doorjamb assembly.

Preferably, in accordance with the invention a plastic extrusion member further defines at least one channel shaped recess for receiving weather strip material therein.

Preferably, the plastic extrusion member will further include an additional interlocking recess for receiving an exterior trim, attachable to the vinyl extrusion around the exterior of the doorway, and providing an attractive finished appearance.

Preferably, the invention will further provide a hook engagement for interengaging with a recess on the wooden door jamb, so that the two may be interengaged together and held securely.

In a further preferred feature, two such hook interengagements are provided, interengageing with suitable channels on opposite sides of the wooden doorjamb, so as to securely engage it from opposite sides.

Preferably, the invention further provides a suitable fastener receiving face on the plastic extrusion through which a fastener may be passed into the wooden doorjamb thereby permanently securing it in position.

Preferably, the invention further provides a reduced thickness portion on the wooden door jamb, which is adapted to receive the metal reinforcement plate, and permit the metal reinforcement plate to lie flat against the Wooden door jamb.

Preferably, the invention further provides that the plastic extrusion member shall have a generally outwardly flared face extending outwardly from the door itself, so as to provide a more attractive entry.

Preferably, the invention further provides that the plastic extrusion member shall incorporate a door stop portion, so that when the door closes, it may securely engage against a portion of the plastic extrusion member.

The invention further comprises a door jamb system having a wooden door jamb portion, an extruded plastic portion and a metallic reinforcement assembled in combination.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

As explained above the invention relates generally to the provision of a composite door jamb having improved security reinforcement and weather stripping, and which is at the same time substantially prefabricated and therefore easy to install and producing a significant cost saving in terms of on site labour costs.

Figure 1:
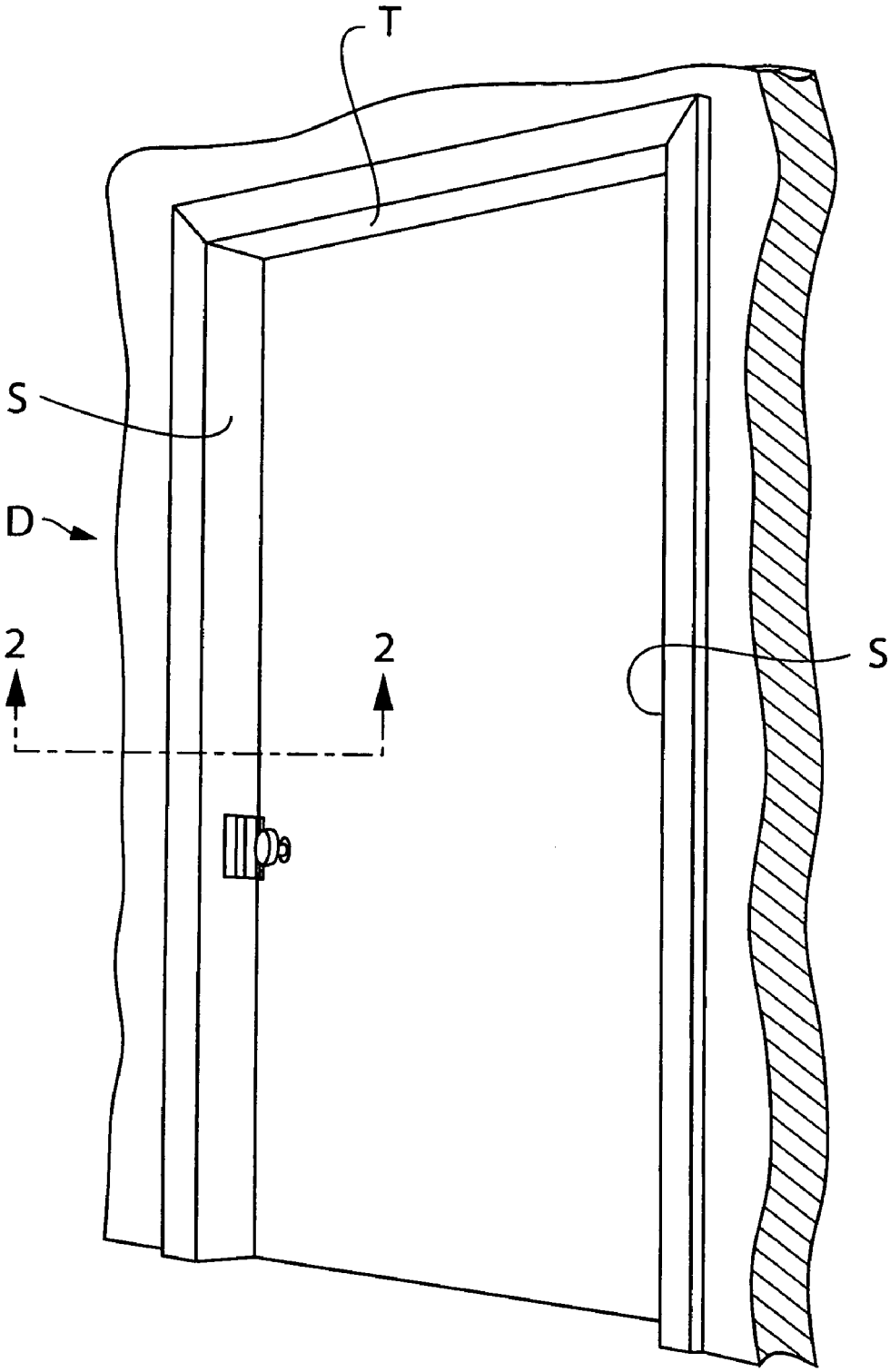
FIG. 1 is a perspective illustration of a doorway, typically an exterior doorway for a dwelling or the like, illustrating the location and use of the door jamb illustrating the invention.

The invention is illustrated in FIG. 1 in general, showing a doorway with a door (D) having side door jambs (S), and a top plate doorjamb (T). In many cases these side door jambs and top door jambs were all simply fabricated of wooden material bought in lengths from a lumber yard, and cut to fit and installed in place.

Also, as of course is well known, one doorjamb (S) is used to receive-the lock set recess hardware (not shown) and the other door jamb is adapted for mounting the door hinges (not shown).

All of this is well known.

In addition, such door frames and doorways provide a door stop against which the door abuts when it is closed, and will usually be provided with some form of weather stripping.

In accordance with the invention, these features are provided by a combination form of door jamb (10) comprising a plastic door jamb member (12), a wooden machined frame member (14), and a metal reinforcement plate (16). The plastic door jamb member (12) the wooden frame member (14) and the metal reinforcement plate (16) are interlocked and assembled together in a manner described below, to provide a combination door jamb having an attractive appearance, weather proofing, and substantially increased security.

Figure 3:
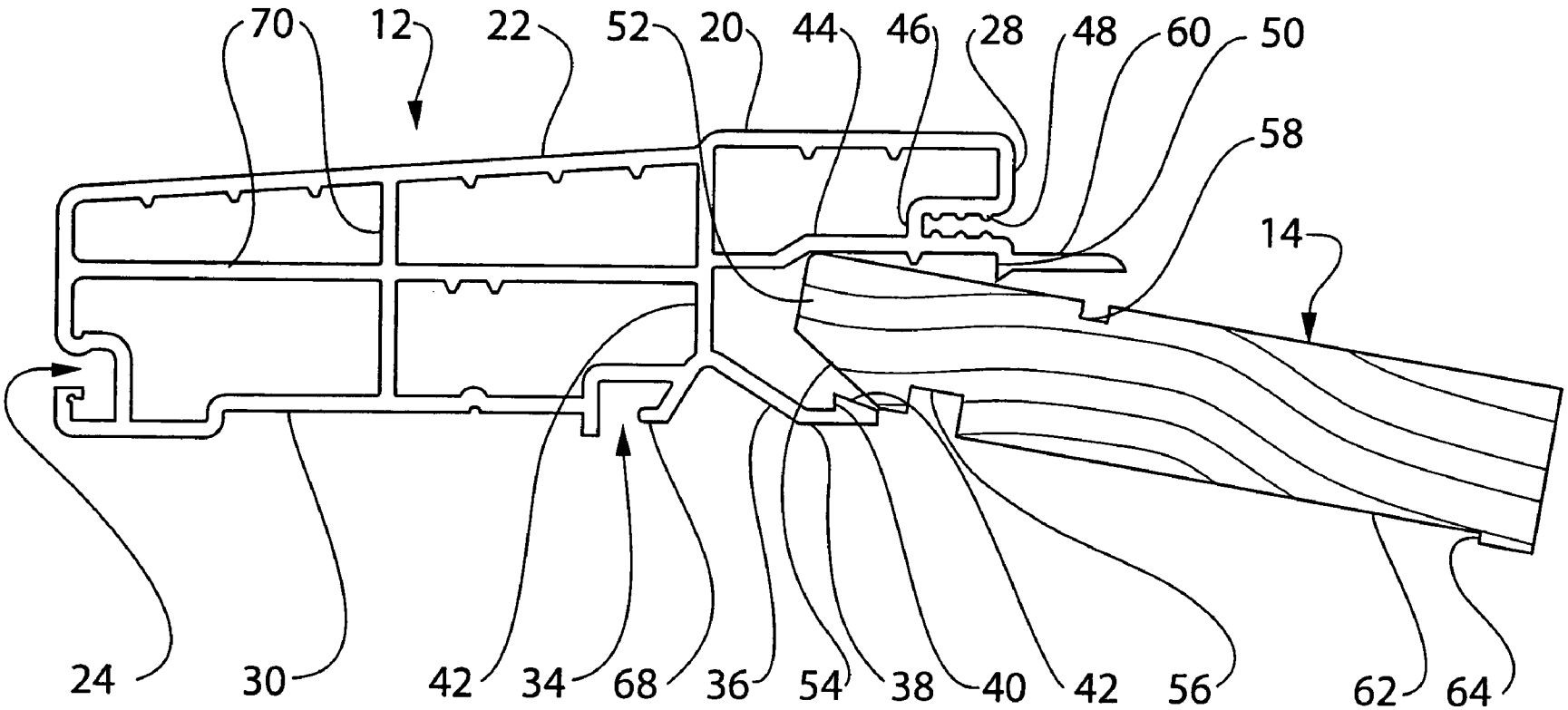
FIG. 3 is a section along the line 3-3 of FIG. 2 showing the parts at a first stage of assembly.
Figure 4:
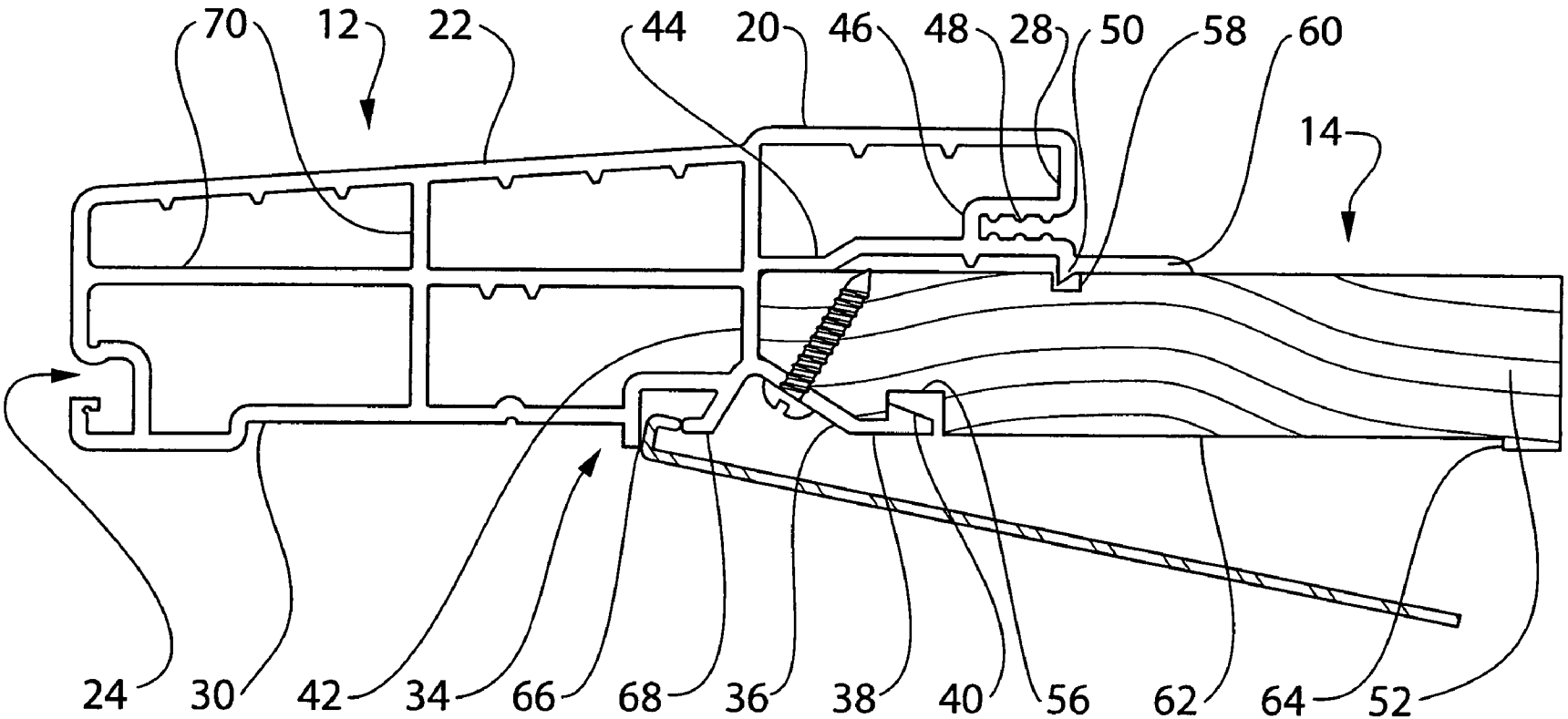
FIG. 4 is a section along the line 3-3 of FIG. 2 showing the parts at a second stage of assembly.

These three members are secured to the structural wood framing (F) of a building. Referring now to FIGS. 3 and 4 it will be seen that the plastic door jamb member (12) comprises a generally hollow plastic extrusion having a doorway outer wall (20), an angled facing plate (22), and an outer trim holding channel (24), forming the majority of the exterior of the doorway. A door stop member (28) is formed at right angles to the door.

On the concealed side of the plastic door jamb member (12), there is a generally rectangular indentation wall (30), connecting with a plate retention groove (34). From the plate retention groove (34), an angled junction wall (36) extends, and a rectangular attachment face (38) extends from the junction wall (36).

From the attachment face (38), a hook extension (40) extends, and is enlarged to provide a generally inwardly sloping surface.

Between the attachment face (38) and outer wall (20), there is a channel (42) defined, and adjacent thereto is an interior channel wall (44).

The interior channel wall (44) extends to meet a weather stripping channel wall (46), which defines a channel for receiving weather stripping.

A further fastening face (48) extends from the weather stripping channel wall (46) and meets door stop member (28).

An interior tooth portion (50) extends from the weather stripping channel wall (46), for reasons to be described below.

In order to cooperate and interfit with the plastic doorjamb member (12), the wooden door frame member (14) already referred to is formed with a tapered nose portion (52), having an angled surface (54) formed thereon, for ease of entry into the channel (42) of the plastic doorjamb member (12).

A first locking channel (56) is formed in the inwardly facing surface of the wooden door jamb frame member (14), for interengagement with the hook extension (40) of the plastic extrusion (12). A second locking channel (58) is formed for interengagement with the tooth portion (50) of the plastic doorjamb member (12). The two channels (56) and (58) interfit with the hook extrusion (40) and the tooth portion (50) respectively in the manner shown in FIGS. 3 and 4. Extension wall (60) extends to overlie the wooden frame member (14).

In order to receive and provide a space for the metallic reinforcement plate (16), the wooden frame member (14) is formed with a planar recessed receiving surface (62), which terminates in a shoulder (64).

Metal reinforcement plate(16) has a retention hook (66) to engage a rib (68) of channel (34) on plastic extrusion (12).

In order to secure the wooden frame member (14) in engagement, a staple or nail (not shown) may be inserted through the plastic extrusion (12), extending into the wooden frame member (14).

To provide additional security, a fastener such as a wood screw, FIG. 4, may be inserted through the junction wall (36) of the plastic door jamb member (12) and will pass into the angled surface (54) of the nose portion (52) of the wooden frame member (14).

Between wall (22) and indentation (30) interior bracing walls (70) are provided for additional support.

Figure 5:
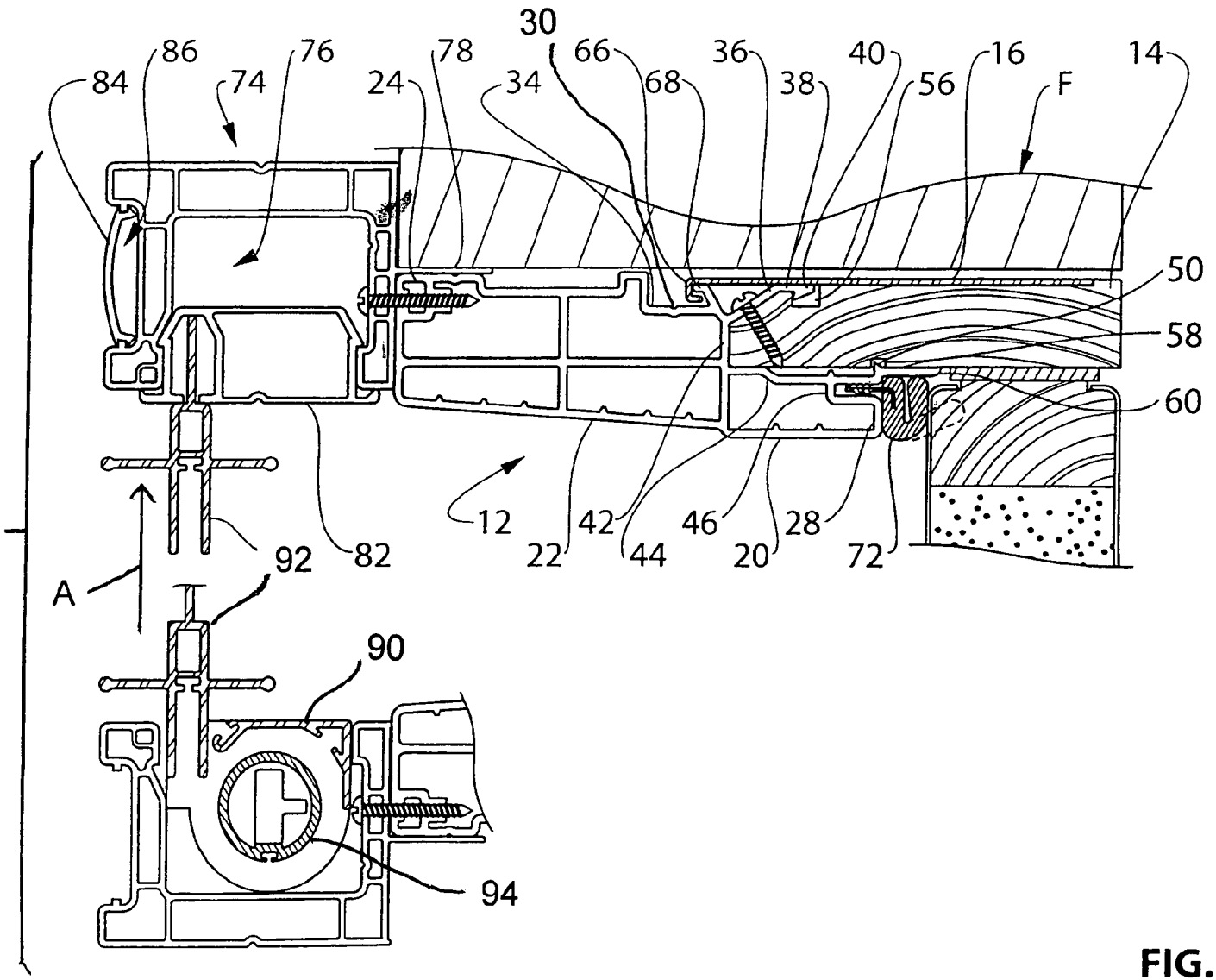
FIG. 5 is a section of an alternative embodiment showing the parts at the final stage of assembly.

As shown in FIG. 5, the extrusion member (12) is usually provided with a door weatherstrip (72) in channel (46).

Figure 2:
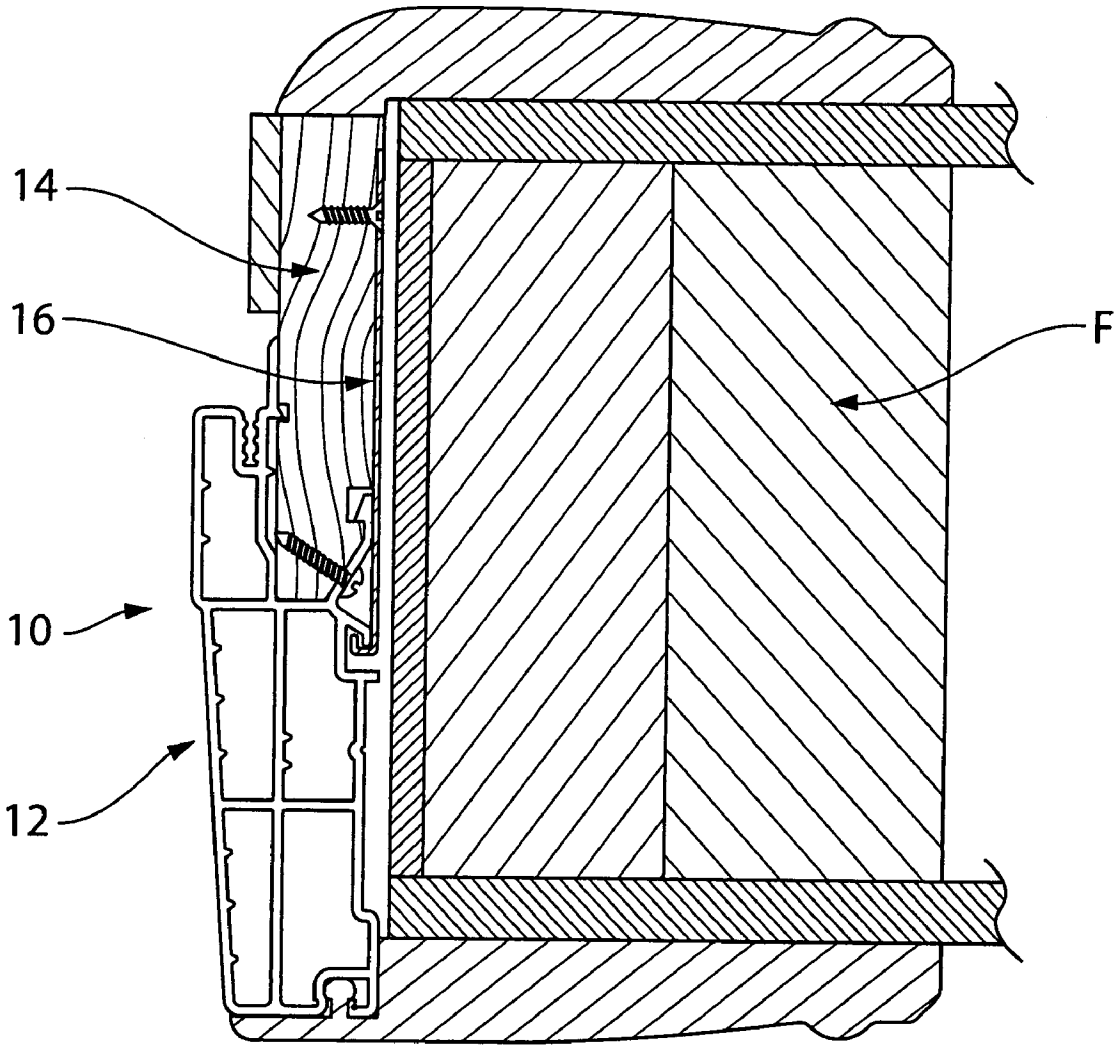
FIG. 2 is a sectional illustration of one side of the doorway along line 2-2 showing the plastic extrusion member, and the wooden doorjamb portion and the metal reinforcement plate on the building structure.

The exterior of the door way may be finished with a simple wood molding as shown in FIG. 2.

However as an added feature, an exterior finish extrusion (74) may be provided on one side of the doorway. Extrusion (74) is of generally three sided rectangular design defining a channel (76). A facing wall (78) locates extrusion (74) against extrusion member (12). A screen (92) (below) can be secured in an extrusion (82) which fits in channel (76). A trim strip (84) can be placed in a channel (86) on extrusion (74).

On the opposite doorjamb, i.e. where the door is hinged, there is an extrusion (90). A roller (94) supports screen (92) and is contained within extrusion (90). Screen (92) can be extended As at A, across the door way, when required and secured to extrusion (82).

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A plastic door jamb assembly for forming a door jamb within the structural wood framing of a building for use in combination with at least one wooden door jamb portion and a metal reinforcement plate, the door jamb assembly comprising;

a wooden door jamb portion defining an inward face, and a tapered nose portion;

a door jamb plastic member in turn comprising, a hollow plastic extrusion having a doorway outer wall, and a concealed side;

a nose channel on said concealed side which receives said tapered nose portion of the wooden door jamb portion;

a metal reinforcement plate lying flat on said inward face of said wooden door jamb portion, between said structural wood framing of a building and said inward face of said wooden door jamb portion;

a plate retention groove in said hollow plastic extrusion for engagement by said metal reinforcement plate;

an angled junction wall on said hollow plastic extrusion extending at an angle from said nose channel overlying said tapered nose portion of said wooden door jamb portion;

an angled surface on said tapered nose portion of said wooden door jamb portion;

a fastener passing through said junction wall of said hollow plastic extrusion and secured into said angled surface of said tapered nose portion of said wooden door jamb portion;

a rectangular attachment face extending from said junction wall, overlying said nose portion of said wooden door jamb portion;

a retention hook on the metal reinforcement plate engageable in said plate retention groove when said metal reinforcement plate is sandwiched between said structural wood framing of a building and said wooden door jamb portion;

a locking channel formed in said wooden door jamb portion;

a hook extension formed on said rectangular attachment face, for interengagement in said locking channel;

a reduced thickness portion on the wooden door jamb portion, which is adapted to receive the metal reinforcement plate, and permit said metal reinforcement plate to lie flat against said wooden door jamb portion, with said metal reinforcement plate overlying said hook extension;

whereby the plastic door jamb member is interengaged with the wooden door jamb member, and with the metal reinforcement plate lying flat against said wooden door jamb member.

2. A plastic door jamb assembly as claimed in claim 1 including a tooth portion on said door jamb plastic member, and a recess in said wooden door jamb portion for interengaging with one another so that the two may be interengaged together and held securely.

3. A plastic door jamb assembly as claimed in claim 2 including locking channel on one side of said wooden door jamb portion, and wherein said recess is on an opposite side of said wooden door jamb portion, thereby forming two channels on opposite sides of the wooden door jamb portion.

4. A plastic door jamb assembly as claimed in claim 1 including a generally outwardly flared face on said plastic door jamb member extending outwardly to provide an entry.

5. A plastic door jamb assembly as claimed in claim 1 including a trim strip placed in a channel formed on an exterior finish extrusion.

6. A plastic door jamb assembly as claimed in claim 1 including a screen door frame which fits in a channel and is secured to an exterior finish extrusion, and exterior the finish extrusion secured to the plastic door jamb member, and wherein said screen door comprises a roller screen extendable across the door way.

7. A plastic door jamb assembly as claimed in claim 1 wherein the door jamb plastic member includes first and second parallel spaced apart upright members and a third door jamb plastic member which is secured to the first and second door jamb plastic members to form the top portion of the door jamb, and, at least one channel shaped recess for receiving a continuous weather strip therein.

8. A plastic door jamb assembly as claimed in claim 1, wherein the door jamb plastic member includes a door stop portion, located whereby to securely engage against a portion of the door.

* * * * *